US006546711B2

(12) United States Patent
Greifeneder et al.

(10) Patent No.: US 6,546,711 B2
(45) Date of Patent: Apr. 15, 2003

(54) SEWING YARN AND PROCESS FOR THE MANUFACTURE OF A SEWING YARN

(75) Inventors: Karl Greifeneder, Heilbronn (DE); Kurt Truckenmueller, Heilbronn (DE)

(73) Assignee: Amann & Soehne GmbH & Co., Boennigheim (DE)

( * ) Notice: Subject to any disclaimer, the term of this patent is extended or adjusted under 35 U.S.C. 154(b) by 0 days.

(21) Appl. No.: 10/135,640

(22) Filed: Apr. 30, 2002

(65) Prior Publication Data

US 2002/0139103 A1 Oct. 3, 2002

Related U.S. Application Data

(62) Division of application No. 09/526,373, filed on Mar. 16, 2000, now Pat. No. 6,425,237.

(30) Foreign Application Priority Data

Mar. 16, 1999 (DE) ..... 199 11 757

(51) Int. Cl.[7] ..... D02G 3/36
(52) U.S. Cl. ..... 57/13; 57/314
(58) Field of Search ..... 57/1 R, 3, 5, 6, 57/13, 14, 200, 210, 211, 224, 236, 237, 314, 315, 362

(56) References Cited

U.S. PATENT DOCUMENTS 4,495,760 A * 1/1985 Vanhelle ..... 57/12
6,131,382 A * 10/2000 Dinkelmann et al. ..... 57/315
6,405,519 B1 * 6/2002 Shaikh et al. ..... 57/12

* cited by examiner

*Primary Examiner*—Danny Worrell
*Assistant Examiner*—Shaun R Hurley
(74) *Attorney, Agent, or Firm*—Greenberg Traurig, P.C.

(57) ABSTRACT

A sewing yarn comprises at least two roving yarns, which are twisted together with one another, whereby each roving yarn has the structure of a core yarn, comprising at least one first multifilament yarn component, forming a yarn core, and a second fiber yarn component spun over the core. In the cross-section of the sewing yarn, the fiber yarn thread covering of at least one roving yarn contains less than 41 individual fibers. For the manufacture of each roving yarn, a slubbing made of fiber yarns is compacted to 10 to 25 times of the volume of the roving yarns, introduced into a spinning device with the multifilament yarn component serving as the core, and is spun in said device, with at least two roving yarns being thereafter twisted together with one another.

27 Claims, No Drawings

SEWING YARN AND PROCESS FOR THE MANUFACTURE OF A SEWING YARN

This application is a divisional application of Ser. No. 09/526,373, filed Mar. 16, 2000 now U.S. Pat. No. 6,425, 237.

BACKGROUND OF THE INVENTION

1. The Technical Field

The present invention relates to a sewing yarn with a process for the manufacture of such a sewing yarn.

Sewing yarns are known in a variety of different structures, whether as sewing thread, as air-intermingled yarns, or as core yarns, whereby each of the structures referred to has its individual advantages and weaknesses respectively.

2. The Prior Art

Sewing yarns which are designed as core yarns comprise at least two roving yarns, whereby these roving yarns, at least two in number, designed as core yarns, are processed by twisting to make finished sewing yarn. Each of these roving yarns in this situation has the structure of a core yarn, of such a nature that each roving yarn encompasses at least one core made of a first multifilament yarn component, whereby this core is then spun with a second fiber yarn component. In other words, a roving yarn of this type has a core-enveloping fiber or sheath structure, whereby the core is formed by the interior multifilament core, designated hereinafter as the first core component, and the sheath is formed by a fiber yarn which surrounds the core and is designated hereinafter as the second yarn component or the second fiber yarn component. Because the second fiber yarn component or the sheath component in such known core yarns is intended to cover the first multifilament yarn component, which provides a major part of the strength of the finished sewing yarn, to provide protection against undesirable damage during sewing, persons skilled in the art have hitherto considered it necessary for such thread covering with fiber yarn to be necessarily so dense that the sewing yarn created from two roving yarns must feature, viewed in the cross-section of the sewing yarn, at least about 45 individual fibers per roving yarn, but as a rule between 50 and 88 individual fibers per roving yarn. This leads to a situation, however, in which such core yarns can only be manufactured with relatively high costs expenditure, due to the relatively high usage of fibers yarn.

The object underlying the present invention is to provide a sewing yarn of the type described, which comprises the structure of a core yarn, and which can be manufactured in a more economical manner than hitherto.

SUMMARY OF INVENTION

This object is achieved according to the invention by a sewing yarn with the characterisation features described hereinbelow.

DETAILED DESCRIPTION OF THE INVENTION

The sewing yarn according to the invention consists, in the same manner as the known sewing yarn described heretofore, of at least two roving yarns, which are twisted together to form the sewing yarn. Each roving yarn in this situation has the structure of a core yarn, whereby this core yarn comprises at least one first multifilament yarn component, forming the core, and a second fiber yarn component surrounding respectively spinning over the core. Viewed in the cross-section of the ready to use sewing yarn, with the sewing yarn according to the invention, the fiber yarn spin over which is later on also called thread covering of the at least one roving yarn comprises a maximum of 41 individual fibers, and for preference less than 41 individual fibers, so that accordingly, in comparison with the prior art described heretofore, the sewing yarn according to the invention has a considerably lower number of fiber yarns in the fiber yarn thread covering which forms the sheath of the roving yarns. In other words, the sewing yarn according to the invention accordingly differs from conventional sewing yarn in that the sewing yarn according to the invention comprises at least one roving yarn, in which the fiber yarn spin over the at least one roving yarn contains decidedly fewer individual fibers than is the case with the prior art.

Surprisingly, it was discovered that the sewing yarn according to the invention, despite the reduced number of individual fibers in the fiber thread covering of the roving yarn or roving yarns comprises even better sewing properties in comparison with other identical but conventional sewing yarns. This is all the surprising, since persons skilled in the art have formerly assumed the minimum individual fiber count referred to heretofore as the prior art, to be at least 45 individual fibers per roving yarn, in order to guarantee adequate coverage and adequate protection of the multifilament yarn components forming the core of the roving yarn. The improved sewing behaviour of the sewing yarn according to the invention, expressed in up to 15% higher sewing speeds or up to 20% longer seams in multidirectional sewing and a high number of button holes without thread breakage produced with the sewing yarn according to the invention, is attributed to the fact that the fiber yarn thread covering of the roving yarn, provided for with the sewing yarn according to the invention, with a maximum of 41 individual fibers or for preference fewer (viewed across the cross-section of the ready to use sewing yarn) on the one hand still provides adequate protection for the multifilament core of each roving yarn against mechanical and/or thermal damage, and, on the other, leads increased structuring because of the reduced individual fiber count in the thread covering, with the result that more air is drawn in by means of such a thread covering, which is reduced in relation to the individual fiber count, as a result of which an improved cooling effect is achieved of the thread guide elements or the needles, which are heated up as a result of the industrial sewing process. Likewise, as a result of a reduction in the individual fibers in the fiber thread cover, the hairiness is reduced, and the risk also reduced of protruding ends of individual fibers becoming caught on the needles or on the thread guide elements, and so incurring a thread breakage during sewing. In addition, the sewing yarn according to the invention also has a substantially reduced thickness, because of the reduction in the number of individual fibers in the fiber yarn thread covering of the minimum of one roving yarn in comparison with a conventional sewing yarn, which has at least 45 individual fibers in the fiber yarn thread covering, with the result that finer seams can also be produced with the sewing yarn according to the invention than was hitherto possible with conventional core yarn. Due to the fact that the sewing yarn according to the invention also requires less use of material due to the reduced individual fiber count in the fiber yarn thread covering, the sewing yarn according to the invention can be produced correspondingly more cheaply than a conventional core yarn. This advantage is emphasized still further with the sewing yarn according to the invention in that, during the spinning over of the roving yarn, only a small volume of material needs to be processed to make fiber yarn, with the result that the manufacturing speeds of the sewing yarns according to the invention can be increased accordingly, in comparison with the manufacturing process of conventional sewing yarns, for preference by between 5% and some 15%.

In order to measure the number of individual fibers with the sewing yarn according to the invention, as provided for in the fiber yarn thread covering of the minimum of one roving yarn, in a reproducible and unambiguous manner, five cross-sections are prepared over a length of 2 meters of the ready to use sewing yarn, with the result that, on the basis of these cross-sections, the fiber yarn thread covering can be microscopically counted in respect of its individual fiber count. This process is then repeated four times in each case after unwinding 50 meters, with the result that 25 cross-sections are then microscopically evaluated accordingly, from which a mean value can accordingly be acquired for the individual number of fibers of the fiber yarn thread covering.

A particularly well-suited embodiment of the sewing yarn according to the invention makes provision for the fiber yarn thread covering of all the roving yarns in this situation, viewed in the cross-section of the sewing yarn, to have a maximum of 41 individual fibers, but for preference less than 41. In other words, with this preferred embodiment of the sewing yarn according to the invention, the sewing yarn is formed by such roving yarns being twisted together in which the individual fiber count of the thread covering is limited to a maximum of 41 individual fibers, and for preference fewer. A sewing yarn of this type will then have the advantages referred to heretofore in comparison with a conventional sewing yarn of otherwise identical structure, to a particular degree, and will also have an extremely low thickness without the technical sewing properties being thereby impaired in any way at all.

Surprisingly, it has been discovered that a particularly suitable embodiment, outstandingly well-suited for many sewing operations, can be provided by this embodiment of the sewing yarn according to the invention comprising at least one such roving yarn, with which the fiber yarn thread covering, viewed in the cross-section of the sewing yarn, has an individual fiber count of between individual fibers 20 and 38 individual fibers. If this embodiment of the sewing yarn according to the invention is manufactured exclusively from such roving yarns in which the fiber yarn thread covering of all the roving yarns, viewed in the cross-section of the sewing yarn, comprises between 20 individual fibers and 38 individual fibers, then such an embodiment of the sewing yarn according to the invention will have even more greatly improved sewing properties and can, in addition, be manufactured with a reduction in the material used and with a further increase in manufacturing speed.

In order to optimise the hairiness of the sewing yarn according to the invention still further, and also to increase the sewing performance even more, one particularly advantageous embodiment of the sewing yarn according to the invention makes provision in this situation for the individual fibers of the fiber yarn thread covering of each roving yarn to have a mean staple length of between 25 mm and 70 mm, and for preference between 33 mm and 43 mm.

A particularly advantageous situation can be created for the achievement of the covering of the multifilament core of each sewing yarn according to the invention, as described in the preamble, is when the total fineness of the fibers used for the fiber yarn thread covering of a Joving yarn varies between 25 dtex and 200 dtex.

In particular, the sewing yarn according to the invention has such roving yarns as possess a total fineness of between 70 dtex and 400 dtex, whereby these roving yarns, formed as core yarns, then contain, in addition to the multifilament core, also the fiber yarn thread covering, forming a sheath, with a maximum individual fiber count of 41 individual fibers and, in particular, less than 41 individual fibers.

A particularly good correlation between the thickness of the sewing yarn according to the invention and the desired properties is attained when the sewing yarn according to the invention consists of two to four roving yarns of the type described heretofore or still to be described hereinafter, which are twisted together with one another to form the sewing yarn. A sewing yarn of this type then has in particular a total fineness, as a ready to use yarn, of between 140 dtex (2×70 dtex) as a minimum, and, in particular, a maximum titre of 1,600 dtex (4×400 dtex), and is especially suitable for almost all sewing operations which may arise.

One particularly high-strength embodiment of the sewing yarn according to the invention is obtained when the first multifilament yarn component forming the core of each roving yarn, or the core of at least one roving yarn, is made of polyester, and in particular of high-strength polyester. This term is to be understood in particular to mean such a polyethylene terephthalate which is also available under the conventional commercial designation of high-strength technical polyester fibers, whereby, in this case, the intrinsic viscosity varies in particular between 0.5 dl/g and 0.75 dl/g, and for preference between 0.55 dl/g and 0.63 dl/g. In this situation, this intrinsic viscosity is determined in appropriate polymer solutions in dichloroacetic acid at 25° C.

With regard to the individual filament titre of the first multifilament yarn component provided for as the core in each roving yarn, it is to be specified that this value varies in particular between 1 dtex and 6 dtex, and for preference between 1.5 dtex and 3 dtex.

For preference, the sewing yarn according to the invention comprises such roving yarns in which the first multifilament yarn component, which forms the core of each roving yarn, has a filament count of between 16 and 300 in particular, and for preference an individual filament count of between 24 and 96.

A particularly advantageous sewing behaviour comprises such embodiments of the sewing yarn according to the invention, in which the second yarn component, which forms the thread covering of each roving yarn, is a fiber yarn made of polyester fibers and/or of cellulosic fibers, and of cotton fibers in particular. In this situation, if a polyester fiber is used as the fiber yarn for the thread covering, then this offers the additional advantage in comparison with the embodiments of the sewing yarn according to the invention which have a thread covering of cellulosic fibers, that a sewing yarn of this type then consists exclusively of polyester, and can therefore be dyed in a single-stage process, making use of one class of dye, namely dispersion dyes.

The term polyester in this text is to be understood to mean such fibers or filaments, which consists exclusively or largely of polyethylene terephthalate.

A particularly good and less hairy covering is ensured with such an embodiment of the sewing yarn according to the invention, with which such fibers are selected for the thread covering of each roving yarn of which the individual fiber titre varies between 0.6 dtex and 4 dtex, and in particular between 0.8 dtex and 2 dtex.

Fibers, fiber yarns, or staple fibers in the meaning of the present application are intended to designate all such concurring structures of fiber form which have a limited length, and in particular a length of between 25 mm and 70 mm.

In particular, each roving yarn in the roving yarn according to the invention has a mass ratio of the first yarn component to the second fiber yarn component which makes up the thread covering of the first yarn component serving as the core, of 50:50 to 75:25, and for preference of 58:42 to 68:32.

A particularly well-suited and easily-dyed embodiment of the sewing yarn according to the invention makes provision for each roving yarn in this situation to have a first yarn component, i.e. a core material, which is identical in terms of material, and which is spun with a fiber yarn thread covering which is identical in terms of material. In other words, with this embodiment, each roving yarn and each fiber yarn thread covering allocated to the roving yarn may be made of polyester, for example, so that this sewing yarn, consisting entirely of polyester, can then be dyed with dispersion dyes in one operating stage. In particular in cases in which the specific strength of each roving yarn varies between 40 cN/tex and 55 cN/tex, a sewing yarn according to the invention manufactured from these roving yarns has a extreme high strength, with the result that it is well-suited for almost all sewing operations.

This comment also applies to such embodiments of the sewing yarn according to the invention in which, for preference, the absolute strength of the roving yarn varies between 320 cN and 2,400 cN.

Independently of the specific and absolute strength values of the roving yarns indicated heretofore, which are reflected in corresponding and almost identical strength values of the ready to use sewing yarns, it is particularly suitable and advantageous if the sewing yarn according to the invention is made of such roving yarns of which the loop strength is between 60% and 70% of the absolute strength and/or the strength values indicated heretofore. It has also been shown in this situation that embodiments of the sewing yarn according to the invention made from roving yarns of this type then likewise provide a loop strength of between 60% and 70% of the absolute strength values of the sewing yarns, so that embodiments of the sewing yarn according to the invention of this kind are especially preferred.

In order to measure this loop strength, in each case two interlacing loops of the roving yarn are tensioned in a breaking force measuring device, and subjected to a load, while measuring the force, until a breaking occurs in the roving yarn or the sewing yarn respectively.

The present invention further refers to a process for the manufacture of the embodiments of the sewing yarn according to the invention as described heretofore.

With the process according to the invention for the manufacture of the sewing yarn according to the invention, first at least two roving yarns are produced, whereby, for the production of each roving yarn, a slubbing made of fiber yarns is introduced into a spinning device together with the multifilament yarn component serving as the core, and is spun in said spinning device. At least minimum two roving yarns produced in this way, which are core yarns, are twisted together, as a result of which the roving yarn according to the invention, is formed. As a departure from the prior art, with the process according to the invention the stubbing of the fiber yarn is compacted directly before being introduced into the spinning device to such an extent that in the ready to use sewing yarn the fiber yarn thread covering of at least one roving yarn, viewed over the cross-section of the sewing yarn, comprises a maximum of 41 individual fibers, and for preference less than 41 individual fibers, and, in particular between 20 individual fibers and 38 individual fibers. In other words, with the process according to the invention, the stubbing of the fiber yarn (the second yarn component) is compressed to such an extent that a reduced number of fiber yarns are spun together with the multifilament yarn component serving as the core, they being for preference twisted together.

The process according to the invention in principle contains, by analogy, the advantages already described heretofore for the sewing yarn according to the invention, and in order to avoid repetition reference is accordingly made to these advantages at this juncture. In particular, however, it is to be pointed out that the process according to the invention can be applied particularly economically, with savings of materials, that it can be carried out more rapidly than the conventional process, and that the sewing yarn according to the invention, produced thereafter, has excellent and universally-applicable sewing properties, such as have been described in detail heretofore.

In order to achieve the savings on fibers in the fiber yarn thread covering, as described with the sewing yarn according to the invention, one particular option is that the stubbing produced by the process according to the invention is compacted immediately before being introduced into the spinning device to such an extent that it corresponds to 10 to 25 times the volume of the spun roving yarn, and in particular to 15 to 20 times the volume of the spun roving yarn. Due to the fact that the slubbing of the fiber yarn, which is introduced into the spinning device together with the core material, has as a rule only a limited thickness, i.e. in particular a thickness of some 1 to 5 layers of the fiber yarn, the volume of the fiber yarn stubbing can be approximately equated with the width which the fiber yarn roving adopts, so that the remark reproduced heretofore with regard to the compacting approximately accords with the remark hereinafter. This means that, with the process according to the invention, the width assumed by the slubbing is compacted to 10 to 25 times, and in particular to 15 to 20 times, the thickness of the spun roving yarn.

In order to attain the compaction of the slubbing as described heretofore, with the process according to the invention, in a particularly simple and effective manner and without interfering with the production sequence, a particularly advantageous method is provided if this compacting of the slubbing is induced by means of compressed air and/or in particular by means of a vacuum.

The roving yarns manufactured in accordance with the process according to the invention, which in each case are produced by spinning, in particular by the twisting of the multifilament core material with a fiber yarn component while maintaining the individual fiber count indicated heretofore, of a maximum of 41 individual fibers, and for preference of less than 41 individual fibers; these roving yarns are then twisted together with the process according to the invention, so forming the ready to use sewing yarn, whereby a twist factor $\alpha$ is selected between 115 and 160.

In particular, with the process according to the invention, the twist factor $\alpha'$, which is applied for the manufacture of the roving yarn, is between 80 and 130, whereby naturally the direction of rotation selected for the twist torsion is contrary to the direction of rotation of the roving yarn.

The twist factors $\alpha$ and $\alpha'$ respectively, as indicated heretofore, are defined in this context as follows:

$$\text{Twist factor } \alpha \text{ or } \alpha' \text{ respectively} = \frac{\text{Twists per metre}}{\sqrt{Nm}}$$

where Nm is the yarn count (titre), given in metric values (counts).

The sewing yarn according to the invention is explained in detail hereinafter on the basis of one example, in comparison with a standard yarn.

To achieve comparison values, in the first instance a roving yarn was spun according to the conventional process, whereby as raw material for this roving yarn a multifilament core with a titre of 139 dtex was twisted together with a fiber yarn of 65 dtex and a twist coefficient α' of 110 in the S-direction. For this, a mass ratio of filament material (multifilament core) of 68.1% and a fiber yarn proportion (fiber yarn thread covering) of 31.9% was selected, whereby the roving yarn produced then had an effective titre of 204 dtex. This roving yarn had a linear strength of 1,040 cN and a specific strength of 50.98 cN/tex respectively, whereby the loop strength was 676 cN.

The fibers of the fiber yarn covering used had an individual titre of 1.3 dtex and have a staple length of 38 mm.

Both the core material and the staple fiber covering consisted of polyester (polyethylene terephthalate).

Two of these roving yarns, which are core yarns, were then twisted together, to form the ready to use sewing yarn, whereby, for this twisting procedure, which was effected in the Z-direction, a twist factor α of 125 was selected. The ready to use sewing yarn produced in this way, which is designated hereinafter as standard sewing yarn, contained a total denier of 440 dtex. From this standard sewing yarn cross-sections were prepared, in order to determine the number of fibres of the fibre yarn thread covering of each roving yarn. To do this, five cross-sections were prepared over a length of 2 meters. The number of individual fibres in the fibre yarn thread covering of each roving yarn was then counted by microscopic means. After unwinding 50 meters of standard sewing yarn in each case, this measurement was then repeated four times, with the result that a total of 25 cross-sections were evaluated by microscopic means.

The measurement of the number of fiber yarns in the cross-section of the ready to use standard sewing yarn revealed that the fiber yarn thread covering of each roving yarn had a mean value of 50.17 fibers.

By making use of the same initial materials (both multifilament core material as well as fiber yarn material), a roving yarn was spun in accordance with the claimed process, whereby, directly in front of the spinning device, into which the multifilament core material and the fiber yarn stubbing were introduced together, the fiber yarn stubbing was compacted to 18 times the thickness of the spun roving yarn, making use of a vacuum. For this joint spinning of the multifilament core with the fiber yarn stubbing, a twist factor α' was selected, which corresponds to the twist factor referred to heretofore. The roving yarn obtained in this way had an effective titre of 188 dtex and a mass distribution of filament to fiber component of 73.9 to 26.1.

The linear strength of the roving yarn produced in this way amounted to 1,060 cN, and the specific strength was 56.38 cN/tex.

The loop strength of the roving yarn was 690 cN.

The roving yarn had an S-rotation. Two of these roving yarns were twisted together for the formation of the sewing yarn, which is designated hereinafter as sewing yarn E, whereby the twisting was effected in the Z-direction, under the twist factor α indicated heretofore.

The number of fibers on each fiber yarn thread covering of each roving yarn was determined by means of cross-sections and microscopic assessment, whereby the method of determination has been described heretofore.

As a result of this determination of the number of fibers in the fiber yarn thread covering of each roving yarn, it can be stated that, with the sewing yarn E, the number of fibers in the fiber thread covering of each roving yarn amounted on average to 37.69. The ready to use sewing yarn had a total denier of 407 dtex.

Thickness measurements of the standard sewing yarn and of the sewing yarn E revealed that the sewing yarn E featured a 10% lower thickness in comparison with the standard sewing yarn.

Under more stringent sewing conditions, i.e. with industrial sewing with a sewing speed of 7,000 stitches a minute of a twill cloth, five layers, the sewing behaviour of the standard sewing yarn was compared with the sewing behaviour of the sewing yarn E. In this situation, it was determined that the sewing behaviour of both yarns was good, but the sewing yarn E in comparison with the standard sewing yarn made possible a 15% longer seam, before thread breakage occurred. This improved sewing behaviour is clear proof of the technical sewing advantage of the sewing yarn E, which differs from the standard sewing yarn solely in the number of fibers in the fiber yarn thread covering of each roving yarn, in the total denier, and in the lower thickness value.

What we claim is:

1. A method of producing a sewing yarn, where said sewing yarn comprises at least two roving yarns, each of which has the structure of a core yarn formed from a slubbing and a multifilament core, and where each of said roving yarns includes a yarn covering comprising less than 41 individual fibers in cross-section of said sewing yarn, the method comprising:

compacting at least two of said slubbings to 10 to 25 times of the volume of each of said at least two roving yarns;

thereafter directly spinning each of said at least two slubbings over at least one of said multifilament core, thereby forming each of said at least two roving yarns; and twisting said at least two roving yarns together with one another to form said sewing yarn.

2. The method according to claim 1, wherein the at least two slubbings are compacted to such an extent that the yarn covering of at least one of said at least two roving yarns, viewed over the cross-section of the sewing yarn, comprises between 20 individual fibers and 38 individual fibers.

3. The method according to claim 1, wherein the at least two slubbings are compacted to such an extent that the yarn coverings of all of the at least two roving yarns, viewed over the cross-section of the sewing yarn, comprise less than 41 individual fibers.

4. The method according to claim 1, wherein each of the slubbings is compacted to such an extent that it corresponds to 15 to 20 times of the volume of each of said at least two roving yarns.

5. The method according to claim 1, wherein the yarn covering comprises a plurality of individual fibers each having a mean staple length of between 25 mm and 70 mm.

6. The method according to claim 5, wherein the yarn covering comprises a plurality of individual fibers each having a mean staple length of between 33 mm and 43 mm.

7. The method according to claim 1, wherein the yarn covering comprises a plurality of fibers with a total titer between 25 dtex and 200 dtex.

8. The method according to claim 1, wherein each of the at least two roving yarns has a total titer of between 70 dtex and 400 dtex.

9. The method according to claim 1, wherein two to four roving yarns are twisted together with one another to form the sewing yarn.

10. The method according to claim 1, wherein the multifilament core consists of polyester.

11. The method according to claim 10, wherein the multifilament core consists of high-strength polyester.

12. The method according to claim 1, wherein the multifilament core comprises a plurality of filaments each having an individual filament titer of between 1 dtex and 6 dtex.

13. The method according to claim 12, wherein the multifilament core comprises a plurality of filaments each having an individual filament titer of between 1.5 dtex and 3 dtex.

14. The method according to claim 1, wherein the multifilament core comprises an individual filament count of between 16 and 300.

15. The method according to claim 14, wherein the multifilament core comprises an individual filament count of between 24 and 96.

16. The method according to claim 1, wherein the yarn covering comprises at least one of polyester and cellulosic fibers.

17. The method according to claim 16, wherein the yarn covering comprises cotton fibers.

18. The method according to claim 1, wherein the yarn covering comprises a plurality of individual fibers each having a titer of between 0.6 dtex and 4 dtex.

19. The method according to claim 1, wherein the yarn covering comprises a plurality of individual fibers each having a titer of between 0.8 dtex and 2 dtex.

20. The method according to claim 1, wherein each of the at least two roving yarns comprises a mass ratio of the multifilament core to the yarn covering of between 50:50 and 75:25.

21. The method according to claim 1, wherein each of the at least two roving yarns comprises a mass ratio of the multifilament core to the yarn covering of between 58:42 and 68:32.

22. The method according to claim 1, wherein the multifilament core and the yarn covering of each of said at least two roving yarns is comprised of the same fiber substrate.

23. The method according to claim 1, wherein each of said at least two roving yarns has a specific strength between 40 cN/tex and 55 cN/tex.

24. The method according to claim 1, wherein each of said at least two roving yarns has an absolute strength between 320 cN and 2,400 cN.

25. The method according to claim 24, wherein each of said at least two roving yarns has a loop strength between 60% and 70% of its respective absolute strength.

26. The method according to claim 1, wherein the compacting of the slubbings is carried out by means of at least one of compressed air and a vacuum.

27. The method according to claim 1, wherein the at least two roving yarns are twisted with a twist factor of between 115 and 160.

* * * * *